United States Patent [19]

Stang et al.

[11] 4,413,597

[45] Nov. 8, 1983

[54] OIL COOLED INTERNAL COMBUSTION ENGINE

[75] Inventors: John H. Stang; Steven N. Cusick, both of Columbus, Ind.

[73] Assignee: Cummins Engine Company, Inc., Columbus, Ind.

[21] Appl. No.: 149,332

[22] Filed: May 13, 1980

[51] Int. Cl.[3] ..... F01P 3/02

[52] U.S. Cl. ..... 123/41.42; 123/41.84; 123/669

[58] Field of Search ..... 123/41.42, 41.79, 41.81, 123/41.83, 41.84, 193 C, 668, 669

[56] References Cited

U.S. PATENT DOCUMENTS

| | | | |
|---|---|---|---|
| 1,634,768 | 7/1927 | Bonner | 123/190 CA |
| 2,078,499 | 4/1937 | Ljungstrom | 123/41.84 |
| 2,085,810 | 7/1937 | Ljungstrom | 123/41.42 |
| 2,944,534 | 7/1960 | Hodkin | 123/41.31 |
| 2,959,163 | 11/1960 | Hodkin | 123/41.42 |
| 3,018,765 | 1/1962 | Neild, Jr. | 123/41.83 |
| 3,127,879 | 4/1964 | Giacosa et al. | 123/41.72 |
| 3,209,659 | 10/1965 | Colwell | 123/193 C |
| 3,315,651 | 4/1967 | Dangauthier | 123/193 C |
| 3,481,316 | 12/1969 | Olson et al. | 123/41.84 |
| 3,687,232 | 8/1972 | Stenger | 184/6.8 |
| 3,714,931 | 2/1973 | Neltz et al. | 123/41.79 |
| 4,108,135 | 8/1978 | Kubis | 123/196 R |
| 4,202,310 | 5/1980 | Zorrilla et al. | 123/41.84 |

FOREIGN PATENT DOCUMENTS

| | | | |
|---|---|---|---|
| 1955805 | 5/1971 | Fed. Rep. of Germany . | |
| 1955806 | 5/1971 | Fed. Rep. of Germany . | |
| 1576407 | 8/1973 | Fed. Rep. of Germany . | |
| 2238445 | 2/1974 | Fed. Rep. of Germany . | |
| 2649562 | 5/1977 | Fed. Rep. of Germany . | |
| 2828466 | 1/1980 | Fed. Rep. of Germany | 123/41.84 |
| 194907 | 3/1923 | United Kingdom . | |
| 2000223 | 1/1979 | United Kingdom . | |
| 1551553 | 8/1979 | United Kingdom . | |

*Primary Examiner*—Craig R. Feinberg
*Assistant Examiner*—W. R. Wolfe
*Attorney, Agent, or Firm*—Sixbey, Friedman & Leedom

[57] ABSTRACT

An oil cooling system for an internal combustion engine (2) includes a cylinder liner (22) shaped to form an annular oil flow passage (36) by an inner flow control surface (52) and outer flow control surface (56) through which engine lubrication oil flows in a very thin film under laminar flow conditions to produce a very large convective heat transfer coefficient of 300–400 BTU's per hour-feet squared-degree Fehrenheit. To insure laminar flow conditions, the radial thickness of the annular flow passage 36 is held to less than 0.016 inches and is preferably in the range of 0.008 to 0.010 inches. The disclosed liner (22) is very accurately positioned within a cylinder bore (8) of the engine block (4) by liner stop means (68) for retaining the liner in a fixed axial position within the cylinder bore (8) and by inner and outer radial locating means (106 and 101) positioned, respectively, inwardly and outwardly of the inner flow control surface (52). Annular oil supply passage (30) and oil collecting passages (66) are also formed to supply and collect, respectively the cooling oil to cause the oil to flow within the flow passage (36) inwardly from the outermost portion of the liner (22) toward the crankshaft (6) for no more than about 40 percent of the total axial length of the liner (22). A secondary combustion gas seal (96) is provided to allow leaked combustion gases to be removed by the cooling lubrication oil.

12 Claims, 6 Drawing Figures

OIL COOLED INTERNAL COMBUSTION ENGINE

DESCRIPTION

Technical Field

This invention relates to internal combustion engines in which the engine cylinders are cooled by the engine lubrication oil.

Background Art

While the concept of using lubrication oil as a primary coolant medium for an internal combustion engine has been studied and tested for many years, no system of this type has yet found widespread commercial acceptance. Many potential benefits, such as reduced engine manufacturing costs and increased operating efficiency and reliability, are known advantages of oil cooling systems yet few commercially available engines employ this type of cooling. In part, the failure of oil cooling to find commercial acceptance has been the result of inadequate appreciation for the heat transfer principles involved. Lacking an accurate model of such principles, designers have had to guess as to the best flow passage geometry and flow characteristics for achieving the optimal performance to cost ratio. Some design suggestions have been experimentally tested, but tests have generally shown the existance of excessive cylinder wall temperatures during engine operation. It is, thus, not surprising that a great variety of proposals have been advanced but none have been widely adopted by commercial engine manufacturers.

U.S. Pat. No. 2,085,810 issued in 1937 to Ljungstrom contains an early disclosure of a system for cooling an engine cylinder by using the lubrication oil of the engine wherein a jacket is placed around the outer surface of each cylinder wall to form an oil flow passage having a thickness which is preferably said to be in the range of 1/32 to ⅓ of an inch. In one embodiment, oil enters the flow passage formed by the jacket through an opening adjacent the mid section of the cylinder and flows generally upwardly through the jacket toward and into the engine head. By causing the oil which enters the flow passage to first contact the cylinder wall well below the hottest section of the cylinder (normally the upper region of the cylinder) a great deal of heat transfer efficiency is lost. Such inefficiency results from the fact that the greatest heat transfer occurs in a liquid medium cooling system generally by bringing the liquid at its lowest temperature into contact with the hottest portion of the structure being cooled. In the embodiment of Ljungstrom referred to above, the cooling oil is first introduced below the mid section of the liner where the oil temperature is increased before it reaches the upper-portion of the cylinder. Thus, the greatest heat removing capability of the engine oil is not concentrated on the liner region normally having the highest operating temperature.

In other embodiments illustrated in the Ljungstrom patent, oil flow through the jacket is unsymmetric with respect to the central axis of the cylinder. This lack of symmetry can lead to greater turbulence within the flow path surrounding the upper region of the cylinder where satisfactory cooling is most important. As the amount of turbulence increases so does the difficulty of constructing a theoretical model which will allow for satisfactory prediction of the heat transfer characteristics of an oil cooling system.

In U.S. Pat. No. 3,127,879 to Giacosa et al., a system for oil cooling the cylinder liners of an internal combustion engine is disclosed which includes formation of a generally cylindrical flow path around the exterior of the liner. After oil enters the flow path below the mid section of the liner, it passes upwardly toward the top of the liner for discharge through a circular channel surrounding the top portion of the liner. In order to intensify heat transfer, Giacosa et al. teaches that it is desirable to provide grooves on the outer surface of the liner to set the oil in "whirling motion". Whatever intensification in cooling is achieved by such "whirling motion", the difficulty of developing an accurate model of the heat transfer characteristics of a system involving such whirling motion is certainly increased. In the absence of an accurate model or very extensive testing, engine designers are normally forced to over design the cooling system to insure satisfactory performance. Such over design can lead to excessive power consumption by the oil flow pump which is logically the lubrication pump of the engine.

If oil cooling is to become widely accepted, it must be compatible with pre-existing engine designs and require minimal component addition and/or redesign. Yet, in the absence of an accurate theory for predicting heat transfer capacity, good engineering practice may dictate flow requirements for oil cooling systems in excess of the capacities of original equipment lubrication pumps. This situation necessitates redesign of the original equipment pump or use of an auxiliary oil cooling system pump. While extensive testing may void some of this problem, the cost of building and testing experimental internal combustion engines renders extremely impractical the trial and error approach to oil cooling system design.

In addition to the approaches illustrated in Ljungstrom and Giacosa et al., other types of oil cooling for internal combustion cylinders are disclosed in U.S. Pat. Nos. 2,944,534 to Hodkin and 3,687,232 to Stenger and in British Pat. No. 2,000,223 to Brighigha. The Hodkin and Brighigha patents disclose cylinder wall oil cooling where the oil flow path forms a helical pattern around the central axis of the cylinder wall. Because the cooling oil contacts only a portion of the outer surface of the cylinder in these designs, excessive temperature in certain areas of the liner are more likely to occur than with systems in which the entire outer surface of the liner is contacted by the cooling oil. Moreover, these references fail to suggest a predictive model for achieving the best possible performance to cost ratio in oil cooling system design and, therefore, do not avoid the design problems noted above. The Stenger patent discloses a complex flow geometry for oil cooling the walls of an engine cylinder but again fails to disclose a mechanism for predicting, and optimizing thereby, the heat transfer characteristics of an oil cooling system.

U.S. Pat. No. 4,108,135 to Lubis discloses an arrangement for external oiling of cylinder liners by providing a very small clearance between the cylinder liners and the surrounding engine block through which oil "seeps" downwardly from an annular oil supply channel provided near the top of the liner. Although Kubis suggests supplying lubrication oil near the top of a cylinder liner, the oil so supplied is not used as a coolant medium for removing heat but serves only to improve the transfer of heat into the surrounding portion of the engine block. Kubis thus fails to address the question of how best to design a cooling system employing lubrication oil to cool the cylinder walls of an internal combustion engine.

Another crucial aspect in designing an optimal oil cooled liner involves the manner by which the liner is mounted within the engine. As noted in a copending application, Ser. No. 959,702 filed Nov. 13, 1978 now U.S. Pat. No. 4,244,330 and assigned to the same assignee as this application, certain advantages result from placement of the liner stop (that is the radial shoulder which holds the liner in a fixed axial location within a cylinder bore) closer to the innermost portion of the liner. Such advantages include improved combustion gas sealing and reduced engine block cracking which results from utilization of the greater natural resilience of the liner. Reduced production costs also result from the use of inwardly positioned liner stops since the close manufacturing tolerances required with "top stop" liner designs can be relaxed. Normally, the use of bottom or mid stop liner designs introduces many complications when the liner is of the more conventional water cooled type. However, an oil cooled liner does not need to provide high integrity in the inner (or lower) oil coolant seal between the engine cylinder and liner since oil which leaks through the inner seal will merely enter the crankcase and thus will return to the oil circuit of the engine. Some prior art oil cooled liners such as disclosed in U.S. Pat. Nos. 3,127,879 to Giacosa et al., and 2,085,810 to Ljungstrom noted above, include bottom stop designs but fail to suggest any technique for exploiting the advantages of bottom stop liners to achieve better combustion gas sealing.

In summary, the prior art describes a great variety of oil cooling systems for internal combustion engines but fails to describe an oil cooling system having sufficiently optimal passage geometry and fluid flow characteristics to be a viable option for commercial engine manufacturers.

SUMMARY OF THE INVENTION

It is the basic purpose of this invention to overcome the deficiencies of the prior art as indicated above by providing a practical oil cooling system for preexisting or new internal combustion engine designs.

One object of this invention is to provide an oil cooling arrangement for the cylinders of an internal combustion engine wherein the oil flowing over the cylinder walls of the engine has a very large conductive heat coefficient of 300–400 expressed in units of BTU per hour-square feet-degree Fehrenheit.

A more specific object of this invention is to provide an oil cooled internal combustion engine design in which the oil flow characteristics are controlled in a manner to make predictable the convective heat transfer coefficient around the engine components being cooled and to achieve modification and damping of engine operating noise.

Another object of this invention is to provide an oil cooling system for the cylinders of an internal combustion engine in which the oil is caused to flow in a very thin film under laminar conditions through an annular oil cooling flow passage surrounding only the outer portion of each engine cylinder. The flow passage is designed to extend axially along the cylinder walls between an annular supply channel adjacent the outermost portion of the cylinder and an annular oil collecting channel positioned inwardly by a predetermined distance less than the total length of the cylinder thereby to limit the axial length of the cylinder which is cooled by direct contact with flowing oil.

A still more specific object of this invention is the provision of apparatus for removing heat from a cylinder bore of an internal combustion engine using engine lubrication oil including means for supplying lubrication oil to and around the entire circumference of the exterior surface of each engine cylinder for passage inwardly toward the crankshaft under laminar flow conditions for a total axial distance no greater than approximately 40 percent of the total axial length of the engine cylinder. In order to achieve the desired laminar flow conditions, a circumferential annular flow passage is formed between the outer wall of each cylinder and a corresponding portion of the engine cylinder block with the radial thickness of the annular flow passage being within the range of 0.006 to 0.016 inches and more preferably being in the range of 0.008 to 0.010 inches.

Another more specific object of this invention is to provide a removable oil cooled cylinder liner having an exterior surface which includes an oil flow passage forming means arranged to induce laminar flow conditions in a very thin annular flow passage extending along no more than approximately 40 percent of the total axial length of the liner combined with very precise positioning means for positioning the liner within the cylinder bore. The positioning means includes outer locating means adjacent the outer end of the liner for forming a precise radial fit with the outermost portion of the cylinder bore and inner locating means positioned inwardly with respect to the oil flow passage forming means for forming a precise radial fit with a corresponding portion of the cylindrical bore when the cylinder liner is mounted therein.

Yet another object of this invention is to provide an oil cooled cylinder liner characterized by less engine block cracking, improved combustion gas sealing and improved loading of cylinder head cap screws. These advantages are achieved by a liner including an oil flow passage as described above including a liner stop for engaging a liner support surface within a cylinder bore for holding the liner in a fixed axial position in which the outermost end of the cylinder liner stands proud of the head engaging surface wherein the liner stop includes a radially oriented stop surface positioned inwardly from the outermost end of the liner by a distance equal to at least 75% of the total axial length of the liner.

It is yet another purpose of this invention to provide an oil cooled liner design wherein the oil flow path which passes in close proximity to the combustion gas seal between the head gasket and outermost end portion of the liner may be used to carry away combustion gases which leak through the combustion gas seal.

Still another object of this invention is to provide an oil cooled internal combustion engine design in which an annular flow passage is formed around the outer portion of a cylinder liner limited to no more than approximately 40 percent of the total axial length and limited to a radial thickness within the range of 0.006 to 0.016 inches further characterized by pump means for supplying oil to the lubrication circuit in a manner to cause oil to flow through the circumferential flow passage at a linear velocity of from 5.3 to 6.6 feet per second with a total pressure drop of 17 to 33 lbs. per square inch.

Other more specific objects of this invention will become apparent from the following Summary of the Drawings.

DESCRIPTION OF THE PREFERRED EMBODIMENTS

Prior oil cooling systems for internal combustion engines have generally been unsuccessful because the heat transfer characteristics of such systems was not sufficiently appreciated. By focusing on such characteristics, it has been discovered that very significantly improved results may be achieved by making slight but critical structural modifications in the design of pre-existing oil cooling systems. In particular, the subject invention is predicated upon the realization that oil films flowing in an annular flow passage having a very thin radial thickness, i.e., below 0.016 inches, will form a small hydraulic diameter and produce, thereby, a large convective heat transfer coefficient. Flow in a cooling passage of this type will generally be laminar and follow the relationship:

$$N_u = \frac{h\,D_h}{k_f}$$

where $N_u$=Nusselt Number h=Convective Heat Transfer Coefficient $D_h$=Hydraulic Flow Diameter $k_f$=Thermal Conductivity of Fluid for an annular channel $D_h$=2t where t=the gap between the liner outside diameter and the surrounding engine block Therefore $$h = \frac{N_u k_f}{2t}$$

It follows from the above relationship that the convective heat transfer coefficient and thus the cooling potential of the system can be increased by reducing the oil film thicknesses. To implement this concept, however, in a manner to produce a practical oil cooling system requires numerous additional considerations beyond the above theoretical analysis. In particular, it is desirable that the oil cooling capability be concentrated adjacent the uppermost portion of each cylinder liner where the greatest operating temperatures of an internal combustion engine can normally be anticipated. Moreover, the close tolerances involved in forming thin films dictates the use of a separately formed cylinder liner, the positioning of which must also be carefully controlled in order to establish the necessary oil flow conditions and at the same time provide adequate combustion gas seal capabilities while minimizing the potential of cylinder block cracking and/or liner distortion. The subject liner design satisfies all of these stringent requirements while achieving an extremely large convective heat transfer coefficient.

Figure 1:
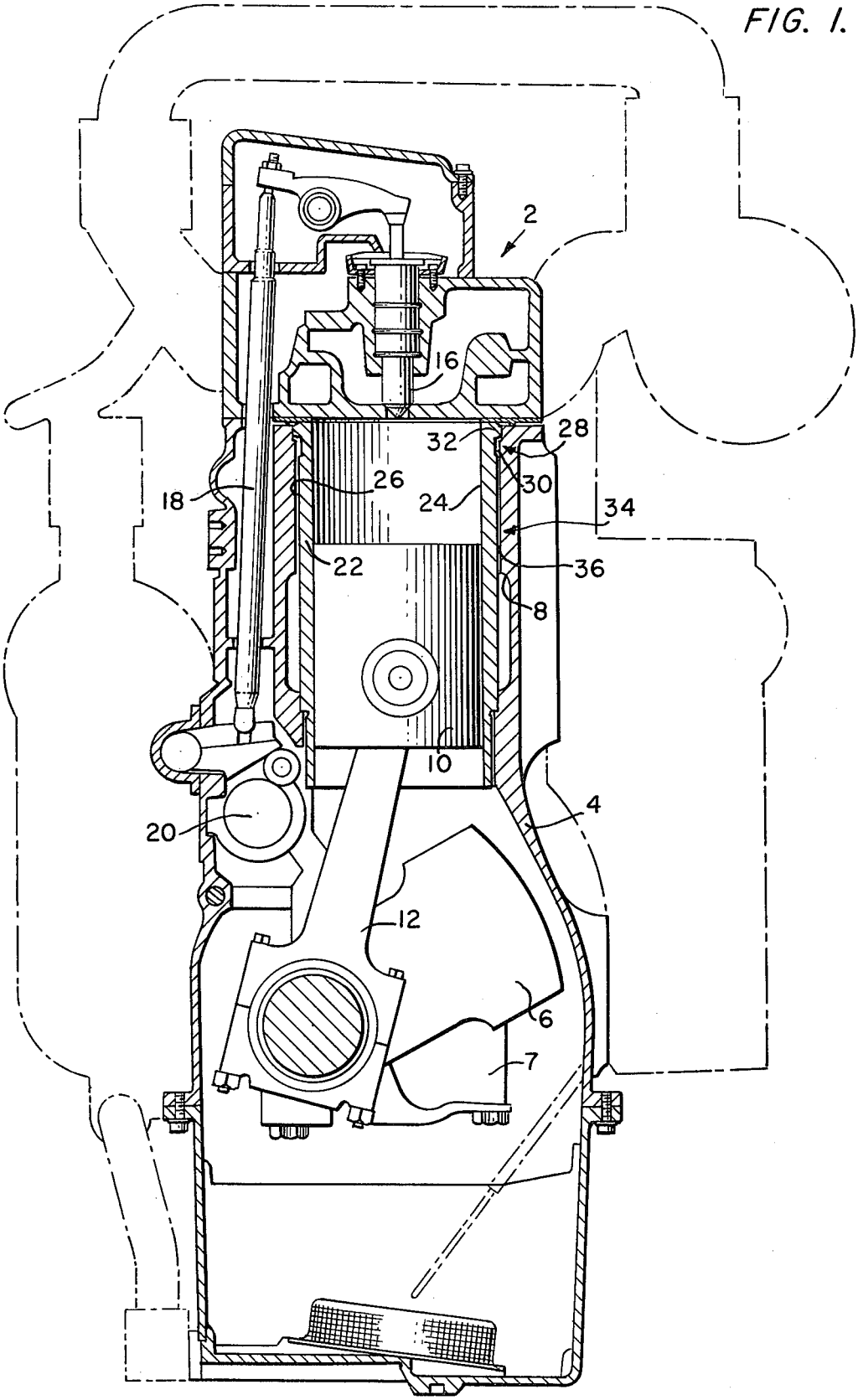
FIG. 1 is a cross sectional view of an internal combustion engine including an oil cooled cylinder liner designed in accordance with the subject invention.

An oil cooled internal combustion engine embodying the subject invention is illustrated in FIG. 1. In particular, an internal combustion engine 2 is illustrated including a cylinder block 4 within which a crankshaft 6 is mounted by means of main bearings 7 for rotation in a generally conventional manner. Cylinder block 4 includes a plurality of cylinder bores 8, only one of which is illustrated in FIG. 1, within which a piston 10 is arranged for reciprocal movement. For purposes of this discussion, the direction and orientation of components will be with reference to the position of the crankshaft 6. Thus, "outward" and "inward" will be used to mean away from and toward the crankshaft 6, respectively.

A connecting rod 12 interconnects piston 10 with crankshaft 6 in a conventional manner to cause reciprocal movement of the piston 10 upon rotation of the crankshaft 6. The removable engine head 14 contains a fuel injector 16 along with intake and exhaust valves, not illustrated. An injector train 18 is connected at one end to the injector and at the other end to the camshaft 20 driven by crankshaft 6 to syncronize operation of the injector 16 with movement of piston 10. In the specific embodiment of FIG. 1, a removable cylinder liner 22 is illustrated in cross-section as having an interior cylindrical surface 24 for guiding the reciprocal movement of piston 10 and an exterior surface 26 through which may pass heat generated within the cylinder bore as will be described in greater detail hereinbelow. Oil for cooling the exterior surface 26 is provided by oil supply means 28 including an annular oil supply channel 30 formed around the outer end of liner 22 in a position just inwardly of a radial flange 32 which forms an interference fit with the outermost portion of the cylinder bore 8.

Oil supply means 28 is connected with the lubrication oil circuit, not illustrated, of the internal combustion engine, and operates to supply lubrication oil to and around the entire circumference of the outer portion of the exterior surface 26 of liner 22 for passage inwardly toward the crankshaft. Laminar flow control means 34 surrounds an outer portion of the exterior surface 26 to form a circumferential flow passage 36 within which the lubrication oil supplied through annular oil supply channel 30 passes under laminar flow conditions in direct contact with the exterior surface 26 in a direction inwardly toward crankshaft generally parallel to the direction of reciprocating motion of the piston 10. For reasons which will be explained in greater detail hereinbelow, the radial thickness of circumferential flow passage 36 should be in the range of 0.006 to 0.016 inches and preferably in the range of 0.008 to 0.010 inches. When the thickness of the circumferential flow passage 36 is held within this range, oil flow therethrough can generally be expected to be laminar whereby the heat transfer equation referred to above can be expected to be generally accurate.

Figure 2:
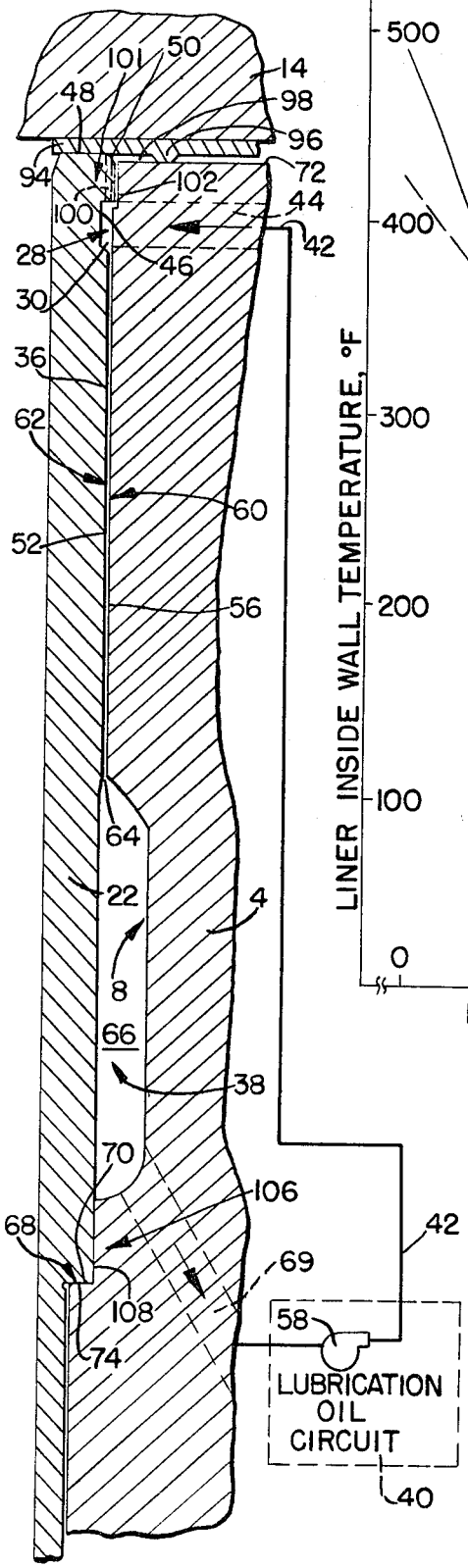
FIG. 2 is an enlarged, broken-away, cross-sectional view of the cylinder liner, cylinder block and engine head assembly of FIG. 1.

Referring now to FIG. 2, an enlarged broken away cross-sectional view of the cylinder liner 22 of FIG. 1 is illustrated wherein circumferential flow passage 36 is shown as extending between annular oil supply channel 30 and an oil collecting means 38 for collecting oil which has passed through the circumferential flow passage 36. The lubrication oil circuit 40 includes a supply passage 42 from which oil enters the annular oil supply channel 30 through oil inlet 44. In the specific embodiment of FIG. 2, the annular oil supply channel 30 is formed in part by a circumferential groove 46 formed near the outermost end 48 of the cylinder liner 22. This circumferential groove 46 is axially positioned between a radial flange 50 (identified as flange 32 in FIG. 1) formed immediately adjacent the outermost end 48 and the circumferential flow passage 36. Thus, oil supplied through oil inlet 44 is evenly distributed circumferentially around the uppermost portion of the annular circumferential flow passage 36 at which point it precedes in an annular flow path between the exterior surface of the cylinder liner 22 and the corresponding surface of the cylinder bore 8.

For reasons which will be explained in greater detail hereinbelow, the circumferential flow passage 36 extends over only a limited portion of the total axial length of cylinder liner 22, preferably no more than approximately 40 percent of the total length thereof. Passage 36 is defined by an inside flow control surface 52 forming one portion of the total exterior surface of liner 22, and by an outside flow control surface 56 forming a portion of the cylinder bore 8. Outside flow control surface 56 is also cylindrical in configuration and concentrically positioned with respect to inside flow control surface 52 when the cylinder liner 22 is placed in its operative position within cylinder bore 8. By very carefully controlling the configuration of these two flow control surfaces the circumferential flow passage 36 may be formed in a manner to insure that oil flowing therethrough will possess substantial laminar flow characteristics and will possess a convective heat transfer coefficient inversely proportional to the radial thickness of the circumferential flow passage 36. While this fact would appear to suggest that the radial thickness should be reduced to an infintesimal size, certain practical considerations limit the degree to which the flow passage thickness may be reduced. In particular, manufacturing tolerances in forming both the inside and outside flow control surfaces cannot be reduced below plus or minus 2 or 3 thousands of an inch without very substantial manufacturing expense. Moreover, the pressure drop of oil passing through the flow passage 36 is effected by the radial thickness which, if decreased too much, will place an excessive burden on the lubrication pump 58 of the internal combustion engine. For economic reasons, it is desirable to utilize preexisting, original equipment lubrication pumps, the capacity of which provides another practical constraint on the degree to which the flow passage 36 may be reduced in radial thickness.

In one sense, the portion of cylinder block 4 on which the outside flow control surface 56 is formed may be considered a laminar flow control means 60 for forming the circumferential flow passage 36 within which the lubrication oil supply by lubrication oil circuit 40 is caused to pass under laminar flow conditions in direct contact with the inside flow control surface 52 of liner 22 in a direction generally parallel to the direction of reciprocating motion of the piston. Correspondingly, the portion of cylinder liner 22 on which the inside flow control surface 52 is formed may be considered an oil flow passage forming means 62 for cooperating with the outside flow control surface 56 when the cylinder liner 22 is mounted within the cylinder bore 8 for forming the circumferential flow passage 36 within which the lubrication oil is caused to pass under laminar flow conditions in a direction generally parallel to the direction of reciprocating motion of the piston.

Flow passage 36 communicates with oil collecting means 38 through an annular opening 64 through which oil passes into a comparatively large volume undercut forming an annular oil collecting channel 66 in the cylindrical bore 8. Oil collected in the channel 66 is fed back into the lubrication oil circuit 40 through an oil outlet 69 (shown in dashed lines) which may lead back to the oil pan or through a heat exchanger (not illustrated) from which heat collected by the oil may be removed prior to the oil being returned to the oil pan.

Because of the criticality of the dimensions of the flow passage 36, the cylinder liner 22 must be very carefully positioned within cylinder bore 8. To accomplish this, cylinder liner 22 is provided with liner positioning means including a liner stop means 68 for engaging a liner support surface 70 formed as a radially oriented ledge near the innermost portion of the cylinder bore 8. The liner stop means 68 is designed to hold the cylinder liner in a fixed axial position in which the outermost end 48 of the cylinder liner stands proud of the head engaging surface 72 of cylinder block 4. By this arrangement, maximum seal forming pressure is concentrated along the outermost end 48 of the cylinder liner 22 as the engine head 14 is pulled against the cylinder block 4 upon torquing of the head bolts (not illustrated). Liner stop means 68 includes a radially oriented stop surface 74 for engaging the liner support surface 70 when the liner is moved into operative position. Stop surface 74 is positioned inwardly from the outermost end 48 of the cylinder liner 22 by a distance sufficient to cause the outermost end of the liner to stand proud of the head engaging surface as indicated above.

Figure 2A:
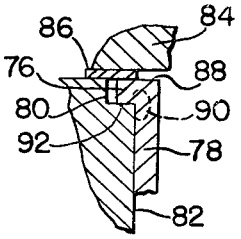
FIG. 2a. (PRIOR ART)
FIG. 2*a* is a broken-away, cross-sectional view of a prior art cylinder liner and head gasket arrangement.

To achieve certain important advantages discussed below, surface 74 of the liner stop means 68 should be positioned from the outermost end 48 by an axial distance which is at least 75 percent of the total axial length of the cylinder liner 22. One example, of the advantages achieved by this configuration are improved combustion gas seal capability and reduced engine block cracking tendencies compared with the more conventional "top flange" arrangement. An example of the prior art configuration is illustrated in FIG. 2*a* wherein the top flange of a liner 78 is shown as being positioned within a counterbore 80 of a cylinder bore 82. A head gasket 86 extends only partially into the space formed between removable engine head 84 and the total upper end surface 88 of liner 78 because the clamping pressure of head 84 is applied to the innermost portion of the cylinder liner would have the effect of placing undue stress in the region 90 (shown in dashed lines) of the cylinder liner 78. Thus, gasket 86 extends only over that portion of the top surface 88 which is coextensive with the ledge 92 formed by counterbore 80. The limitation imposed by the configuration in FIG. 2*a* should be contrasted with the present invention wherein the liner stop means 68 is positioned at such a great distance from the outermost end 48 of the cylinder liner 22 that it is possible to extend head gasket 94 to be coextensive with the entire space formed between the outermost end 48 and the engine head 14. For reasons more fully explained in the commonly assigned application Ser. No. 959,702, filed Nov. 13, 1978, placement of the stop means 68 far into the cylinder bore has the added advantage of advantageously utilizing the natural resilience of the cylinder liner to lower the manufacturing tolerances involved in forming the cylinder liner 22 while also improving the reliability of the combustion seal formed between the head gasket and the cylinder liner.

In addition to precisely locating cylinder liner 22 in an axial position with respect to cylinder bore 8, the liner positioning means further includes outer locating means 101 formed in part by radial flange 50 and a small counterbore 102 of cylinder bore 8. Radial flange 50 and counterbore 102 are manufactured to form an interference fit designed to position the outermost end of the cylinder liner 22. Inner locating means 106 positioned inwardly from the inside flow control surface 52 is further provided for forming a precise radial fit with the corresponding portion of the cylinder bore 8 when the cylinder liner 22 is mounted therein. Inner locating means 106 includes a piloting surface 108 which may be formed adjacent to and on either side of the radially oriented stop surface 74 for interacting with a corresponding surface formed in cylinder bore 8 for piloting the liner 22 into position as the liner is moved axially into operative position within the cylinder bore 8. While the piloting surface 108 could be formed to produce an interference fit with the corresponding section of the cylinder bore 8, the preferred embodiment is to provide a 0.001 to 0.006 clearance between these surfaces.

Another advantage of utilizing oil cooling in the manner illustrated in the specific embodiment shown in FIG. 2, is the ability to remove combustion gases which unavoidably leak in minute quantities past the combustion gas seal by providing a secondary gas seal means 96 positioned radially outwardly from the contact area between the head gasket 94 and the outermost end of the cylinder liner 48 to define a gas collection channel 98 for collecting combustion gases which leak out of the cylinder bore 8. An axial passage 100 formed in radial flange 50 provides communication between the annular oil supply channel 30 and the gas collection channel 98 to allow leaked combustion gases to be carried away by the oil flowing in cooling relationship with the cylinder liner.

Figure 3:
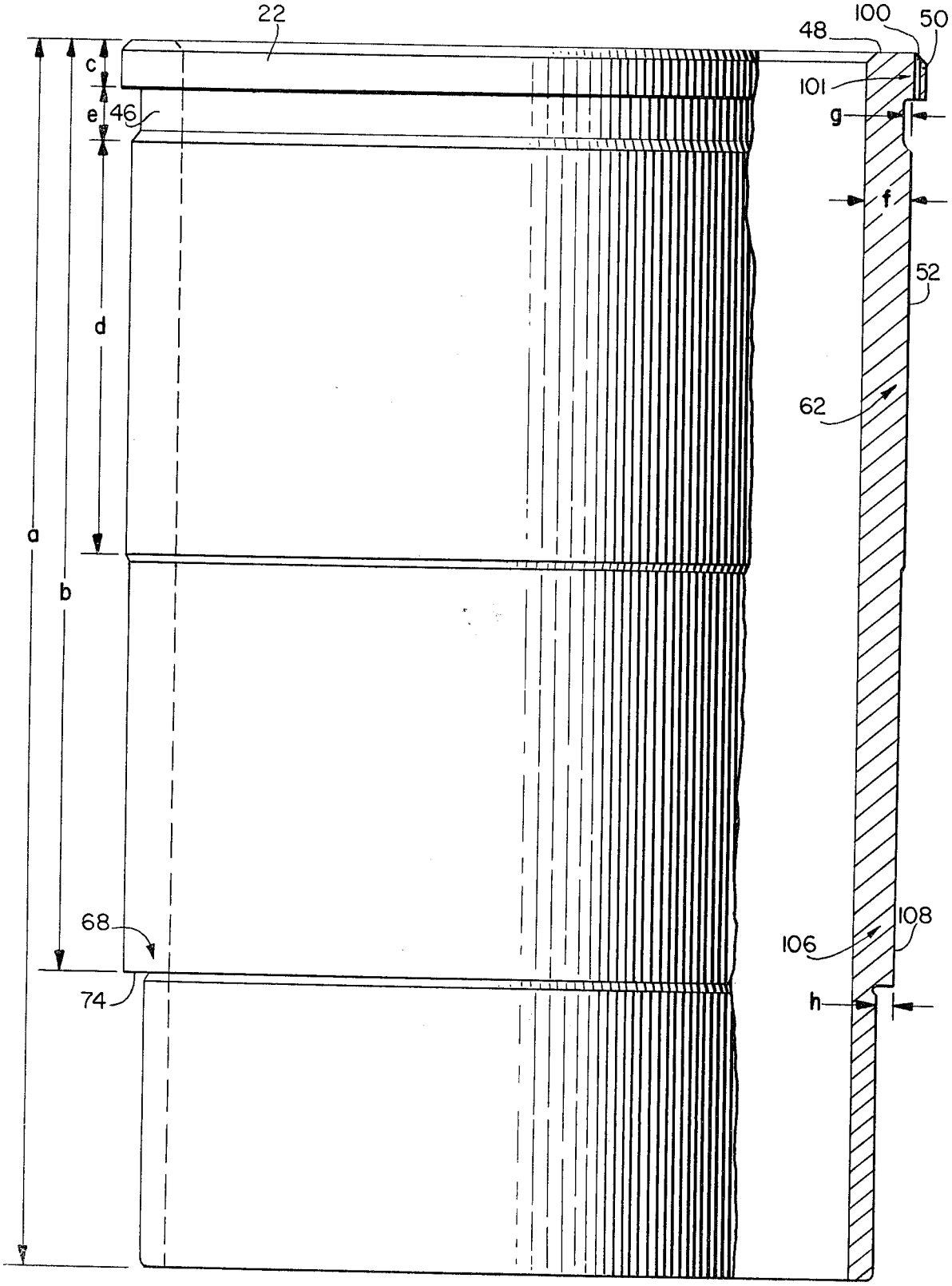
FIG. 3 is a partial cross-sectional view of the oil cooled cylinder liner of FIGS. 1 and 2.

Turning now to FIG. 3, a partially broken away view of a preferred configuration of a cylinder liner 22 designed in accordance with the subject invention is disclosed. The portions of the liner discussed above are identified by the same reference numerals used in FIGS. 1 and 2. The total axial length a of this liner may be any amount suitable to the particular internal combustion engine for which the liner is designed. By virtue of the oil flow passage design possible by formation of an oil cooled cylinder liner in accordance with this invention, it is possible to rather accurately predict the cooling capacity which can be achieved when certain oil flow characteristics are provided. In particular, if the radial thickness of the annular flow passage 36 as illustrated in FIG. 2 is assumed to residue within the range of 0.008 to 0.010 inches, and the oil flow velocity through this passage is held to the range of 5.3 to 6.6 feet per second with a total pressure drop of 17 to 33 lbs. per square inch, it is possible to predict that the total axial length d of the flow passage need be no more than approximately 40 percent of the total axial length a of the liner. When configured in this way, the total flow through the flow passage of each cylinder of an engine would be approximately 3.3 gallons per minute. Based upon the theoretical equations discussed above, the convective heat transfer coefficient under these conditions would be 300–400 expressed in units of BTU per hour-feet squared-degree Fehrenheit. With such a large convective heat transfer coefficient, the operating temperatures on the inside wall of the liner configured as illustrated in FIG. 3 would be well within an acceptable range.

The following chart represents the actual dimensional characteristics of a cylinder liner having the configuration illustrated in FIG. 3 which has been designed and successfully tested by the assignee of this invention:

a=10.4 inches
b=8.5 inches
c=0.25 inches
d=4 inches
e=0.3 inches
f=0.35 inches
g=0.1 inches
h=0.18 inches
i=5.5 inches As discussed above, the distance of the radially oriented stop surface 74 from the outermost end 48 of the liner 22 should be in excess of 75 percent of the total length of the liner.

Figure 4:
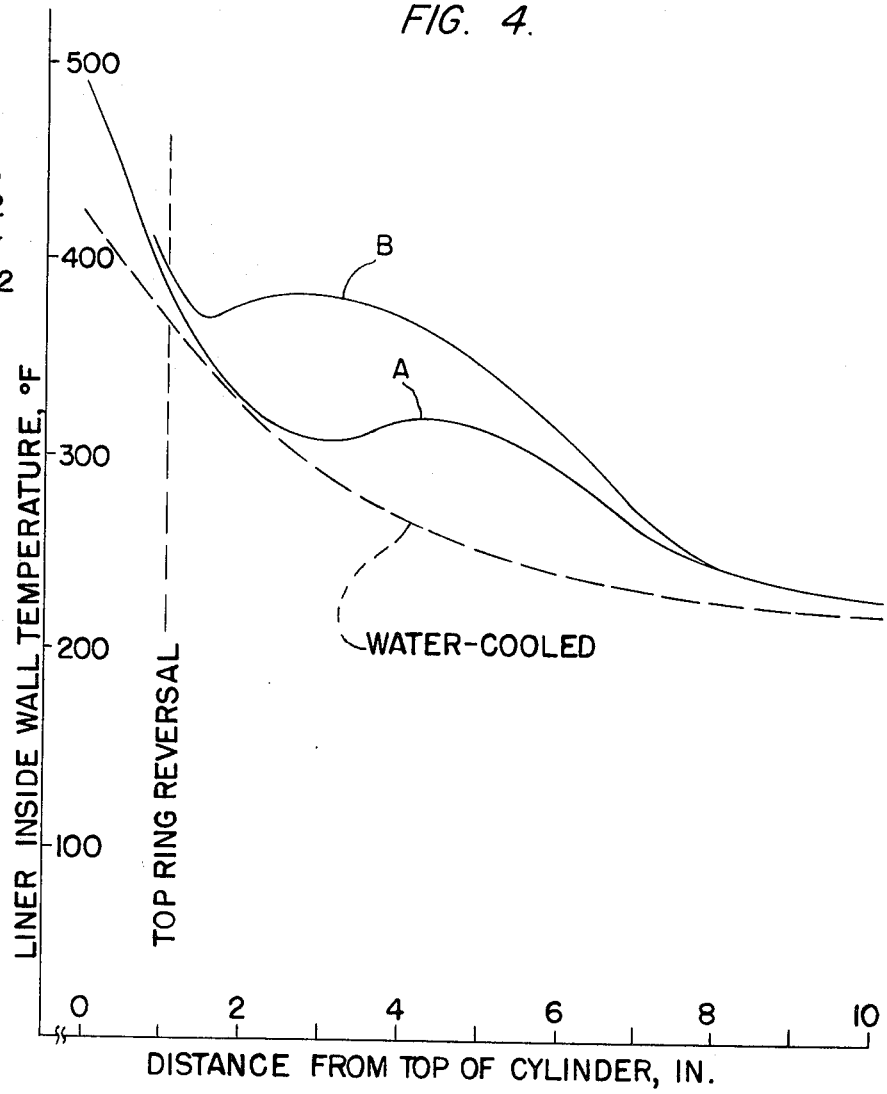
FIG. 4 is a comparative graph of the predicted temperature distribution along the axial lengths of a prior art water cooled liner and a pair of oil cooled cylinder liners formed in accordance with the subject invention.

Referring now to FIG. 4, a graph is illustrated of the estimates of liner inside wall temperatures versus the distance from the outermost or top portion of the cylinder liner for three separate liner configurations when used in a 350 horsepower compression ignition engine of the type sold by the assignee of this application under the trade designation NTC-350. When such an engine is equipped with a water cooled cylinder liner, the inside wall temperatures can be expected to follow the dashed curve illustrated in the graph. Where an oil cooled liner formed in accordance with the subject invention is provided with an oil flow passage having a thickness of 0.009 inches and an oil flow of 3.3 gallons per minute per cylinder, line A represents the predicted inside wall temperatures given an axial flow passage length (d in FIG. 3) of 4 inches. Line b discloses the predicted inside wall temperatures for the same engine operated under the same conditions when equipped with a cylinder liner of the design in FIG. 3 wherein the total axial length (d) of the oil cooling flow channel is limited to 2.0 inches in the axial direction of the cylinder liner.

At the critical point shown by the line labelled top ring reversal, it is apparent that the predicted inside wall temperatures for both oil cooled liner designs are very close to those achieved when the engine is cooled by a conventional water coolant system. For a 4 inch length oil coolant flow passage, the predicted inside wall temperatures remain acceptably close to the temperatures produced by conventionally water cooled cylinder liner design along the entire length of the cylinder liner. Actual tests conducted by the assignee of this invention have verified that liners designed in accordance with the subject invention will, in fact, operate very close to the temperature predicted in lines A and B. These tests have also confirmed a qualitative improvement in the operating noise generated by internal combustion engines of the compression ignition type when such engines are equipped with oil cooled liners designed in accordance with the subject invention.

Figure 5:
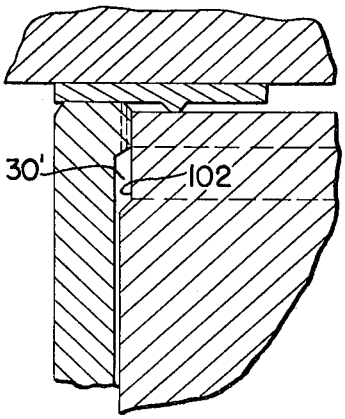
FIG. 5 is a partial cross-sectional view of an alternative embodiment of an oil cooled cylinder liner design formed in accordance with the subject invention.

An alternative arrangement for forming the annular oil supply channel is illustrated in FIG. 5 wherein the circumferential groove 46 shown in FIG. 2 has been eliminated in favor of extending the counterbore 102 for a greater axial distance in cylinder bore 8 thereby to provide an annular oil supply channel 30' in the same axial position as shown in FIG. 2 without necessitating the formation of a circumferential groove in the cylinder liner.

For the first time a practical oil cooled cylinder design has been disclosed in which the oil flow passages are formed in a way to insure the passage of a very thin film of oil flowing generally under laminar flow conditions in immediate proximity to only a limited portion of the total axial length of a cylinder liner. By this invention acceptable operating temperatures are maintained without exceeding the capability of original equipment lubrication pumps normally provided with commercially available internal combustion engines. Moreover the subject invention has led to a variety of improved structural and functional improvements in oil cooled cylinder liners.

We claim:

1. Apparatus for removing heat from a cylinder bore of an internal combustion engine having a block containing the cylinder bore and having a head engaging surface, a radially oriented liner support surface in the cylinder bore, a crankshaft, a piston connected to the crankshaft for reciprocating movement within the cylinder bore, a removable head for closing one end of the cylinder bore when brought into contact with the head engaging surface of the block, and a lubrication oil circuit for recirculating lubrication oil through the engine, said apparatus comprising:

(a) cylinder means having an interior surface for guiding the reciprocating movement of the piston inwardly and outwardly with respect to the crankshaft and an exterior cylindrical surface through which may pass heat generated within the cylinder bore; said cylinder means includes a cylinder liner removably positioned within the cylinder bore, said cylinder liner including a radial flange formed adjacent the outermost end thereof for engaging the outer portion of the cylinder bore in an interference fit, said cylinder liner further including a liner stop means for engaging the liner support surface to hold said cylinder liner in a generally fixed axial position in which the outermost end of the cylinder liner stands proud of the head engaging surface to cause said cylinder liner to be biased into operative position when head is mounted on the block;

(b) oil supply means connected with the lubrication oil circuit for supplying lubrication oil to and around the entire circumference of the outer portion of said exterior surface of said cylinder means for passage inwardly toward the crankshaft along said exterior surface;

(c) laminar flow control means surrounding an outer portion of said exterior surface for forming a circumferential flow passage located outwardly from the liner support surface when said liner is placed in operative position within which the lubrication oil supplied by said oil supply means passes under laminar flow conditions in direct contact with said exterior surface in a direction generally parallel to the direction of reciprocating motion of the piston, said laminar flow control means includes an outside flow control surface concentrically disposed around said exterior surface and spaced therefrom by a distance in the range of 0.006 to 0.016 inches;

(d) oil collecting means connected with the lubrication oil circuit for collecting oil which has passed through said circumferential flow passage, said oil collection means communicates with said circumferential flow passage through an annular opening formed at the inner end of said circumferential flow passage, said annular opening being spaced axially from said oil supply means by a distance which causes said lubrication oil to flow under laminar flow conditions over said exterior surface for no more than approximately 40 percent of the total axial length of said cylinder means;

(e) a head gasket being co-extensive with the entire space between said outer end of said cylinder liner and the head when in operative position to cause the force axially applied by the head to be evenly distributed over the entire outermost end surface of said cylinder liner, said head gasket includes a secondary combustion gas seal means positioned radially outwardly from the contact area between said head gasket and the outermost end of said cylinder liner to define a gas collection channel for collecting combustion gases which leak out the cylinder bore and wherein said radial flange includes a passage interconnecting said collection channel with said annular oil supply channel to allow leaked combustion gases to be carried away by the lubrication oil passing through said annular oil supply channel.

2. An oil cooled cylinder liner for use in an internal combustion engine containing a cylinder bore extending inwardly from a surface for engaging an engine head toward a crankshaft to which is connected a piston for reciprocating travel within the cylinder bore and having a radially oriented liner support surface positioned inwardly from the head engaging surface and further having a lubrication oil circuit including an oil inlet for supplying oil to an exterior surface of the cylinder liner at a point axially adjacent the head engaging surface and still further having a cylinderical outside flow control surface formed on the interior of the cylinder bore having a fixed radius starting adjacent the oil inlet and extending inwardly, said cylinder liner comprising:

(a) a generally hollow cylindrical body having an interior cylindrical surface for guiding the piston during reciprocating movement and having an exterior surface one portion of which includes an oil flow passage forming means for cooperating with the outside flow control surface when the cylinder liner is mounted within the cylinder bore for forming a circumferential flow passage through which a very thin film of lubrication oil of uniform radial thickness may pass under laminar flow conditions having no circumferential component and having a linear component in a direction parallel to the central axis of said hollow cylindrical body and extending inwardly from the oil inlet when the liner is mounted within the cylinder bore, said oil flow passage forming means including an inside flow control surface having a fixed radius along its entire length which is 0.006 to 0.016 inches less than the radius of the outside flow control surface; and (b) liner positioning means for positioning said inside flow control surface concentrically within the outside flow control surface when said hollow cylindrical body is positioned within the cylinder bore to form the oil flow passage between said inside flow control surface and the outside flow control surface with a constant radial dimension between 0.006 and 0.016 inches throughout the axial and circumferential extent of the oil flow passage, said liner positioning means including:

(1) outer locating means adjacent the outer end of said hollow cylindrical body for forming a precise radial fit with the outermost portion of the cylinder bore, said outer locating means including a radial flange positioned outwardly from said inside flow control surface, and (2) inner locating means positioned inwardly from said inside flow control surface for forming a precise radial fit with a corresponding portion of the cylinder bore when the cylinder liner is mounted within the cylinder bore.

3. An oil cooled cylinder liner as defined in claim 2, wherein said radial flange includes a passage extending axially from the outer side to the inner side of said radial flange to allow leaked combustion gases to be carried away by the lubrication oil passing through said oil flow passage.

4. An oil cooled cylinder liner as defined in claim 2, further including oil collecting means connected with the lubrication oil circuit for collecting oil which has passed through said circumferential flow passage, said oil collection means communicates with said circumferential flow passage through an annular opening formed at the inner end of said circumferential flow passage.

5. Apparatus as defined in claim 4, further including pump means for supplying oil to said lubrication circuit in a manner to cause oil to flow through said circumferential flow passage at a liner velocity from 5.3 to 6.6 feet per second with a total pressure drop of 17 to 33 pounds per square inch.

6. An oil cooled cylinder liner as defined in claim 2, wherein said liner positioning means further includes a liner stop means having a radially oriented stop surface for engaging said liner support surface, said stop surface being positioned inwardly from the outermost end of said cylinder liner by a distance sufficient to cause the outermost end of said hollow cylinder body to stand proud of the head engaging surface when said cylindrical body is positioned within the cylinder bore.

7. An oil cooled cylinder liner defined in claim 6, wherein said piloting surface is positioned outwardly from said radially oriented stop surface.

8. Apparatus as defined in claim 6, wherein said stop surface is positioned from the outermost end of said cylinder liner by an axial distance which is more than 75 percent of the total axial length of said cylinder liner.

9. An oil cooled cylinder liner as defined in claim 2, wherein said radial flange forms an interference fit with the cylinder bore when the liner is mounted within the cylinder bore and wherein said inner locating means includes a piloting surface for piloting the liner into operative position as the liner is moved axially into the cylinder bore.

10. An oil cooled cylinder liner as defined in claim 9, wherein said cylindrical body contains a circumferential groove located in the exterior surface of said cylindrical body inwardly from said radial flange for distributing oil from the oil inlet around the entire outer perimeter of said inside flow control surface, said inside flow control surface extending over an axial distance which is equal to but no greater than the axial distance over which laminar flow of oil is required to achieve adequate cooling of said cylindrical body, said inside flow control surface extending over no more than approximately 40 percent of the axial length of said cylindrical body.

11. An oil cooled cylinder liner as defined in claim 9, further including liner stop means for engaging the liner support surface to hold the hollow generally cylindrical body in a fixed axial position in which the outermost end of the cylinder liner stands proud of the head engaging surface when said cylindrical body is positioned within the cylinder bore and the outer end of said cylindrical body is biased inwardly, said liner stop means including a radially oriented stop surface for engaging said liner support surface, said stop surface being positioned inwardly from the outermost end of the cylinder liner by a distance slightly greater than the axial distance of the liner support surface from the head engaging surface.

12. An oil cooled cylinder liner as defined in claim 11, wherein said inner locating means includes a piloting surface formed on the exterior of said cylinder liner, said piloting surface being formed adjacent said radially oriented stop surface.

* * * * *